US005899607A

United States Patent [19]

Kawaguchi et al.

[11] Patent Number: 5,899,607

[45] **Date of Patent: * May 4, 1999**

[54] DEVELOPING DEVICE PROVIDED WITH A PLURALITY OF DEVELOPER CONVEYING MEMBERS

[75] Inventors: Hideshi Kawaguchi, Toride; Kanji Yokomori, Odawara, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/662,171

[22] Filed: Jul. 17, 1996

[30] Foreign Application Priority Data

Jul. 21, 1995 [JP] Japan ..... 7-206801

[51] Int. Cl.[6] ..... G03G 21/00

[52] U.S. Cl. ..... 399/254; 399/258; 399/262

[58] Field of Search ..... 399/254, 255, 399/256, 27, 58, 111, 119, 222, 227, 229, 252; 118/657, 658

[56] References Cited

U.S. PATENT DOCUMENTS

| | | | |
|---|---|---|---|
| 5,095,340 | 3/1992 | Mahoney | 399/254 |
| 5,257,076 | 10/1993 | Nishimura et al. | 399/254 |
| 5,576,814 | 11/1996 | Nishimura et al. | 399/254 |

*Primary Examiner*—D. Rutledge

*Attorney, Agent, or Firm*—Fitzpatrick, Cella, Harper & Scinto

[57] ABSTRACT

A developing device for developing a latent image on an image carrying member includes a container member containing toner; a development roller provided at a development opening of the container member; a first toner conveying member disposed so as to face the development roller, wherein a direction of rotation of said first developer conveying member is opposite to a direction of rotation of said developer carrying member; and a second toner conveying member provided further downstream from the first conveying member as viewed in the direction of rotation of the development roller and having a higher conveying capability than the first toner conveying member. The toner circulation capability around the development roller is very high.

10 Claims, 9 Drawing Sheets

DEVELOPING DEVICE PROVIDED WITH A PLURALITY OF DEVELOPER CONVEYING MEMBERS

BACKGROUND OF THE INVENTION

1. Field of the Invention

The present invention relates to a developing device utilized in an image forming apparatus such as an electrophotographic or electrostatic recording type copying machine, printer, facsimile, or the like.

2. Description of the Related Art

A known image forming apparatus such as a laser beam printer, copying machine, or the like, incorporates a process cartridge that can be easily mounted to and dismounted from the apparatus body. The process cartridge incorporates in a unitary structure process units such as a photosensitive drum serving as a latent image carrying- member, a charger, a developing device, cleaner means, and the like.

FIG. 8 is a cross sectional view of a conventional process cartridge. Toner $T_{11}$ in a toner container 11 is conveyed toward a development roller 9*b* by means of a conveying member 9*a*. When the amount of toner is increased in order to prolong the life of such a cartridge, sufficient stirring of the toner cannot be achieved by the conveying member 9*a* alone.

A possible solution to this problem is to increase the toner conveying capability in the container by placing a plurality of the toner conveying members 9*a* as illustrated in FIGS. 9A and 9B.

However, in such a construction, more toner in the process cartridge may lead to poor toner circulation, so that the image begins to fade as the copying or printing operation is continued in the apparatus body.

SUMMARY OF THE INVENTION

Accordingly, an object of the present invention is to provide a developing device capable of containing a large amount of developer.

Another object of the present invention is to provide a developing device in which excellent circulation of the developer can be achieved.

Still another object of the present invention is to provide a developing device including a container member containing a developer; a rotating developer carrying member which is provided at the opening of the container member, and carries the developer in the container as the developer carrying member rotates; a first developer conveying member disposed so as to face the developer carrying member, wherein a direction of rotation of the first developer conveying member is opposite to the direction of rotation of the developer carrying member; and a second developer conveying member disposed further downstream from the first developer conveying member as viewed in the direction of rotation of the developer carrying member. In the developing device, the second developer conveying member provides a greater conveying force than the first developer conveying member. Further, the direction of rotation of the second developer conveying member is the same as the direction of rotation of the developer carrying member.

Other objects of the present invention will become apparent from the descriptions that follow.

DESCRIPTION OF PREFERRED EMBODIMENT

A description will now be given of an embodiment of the present invention with reference to the drawings.

Figure 3:
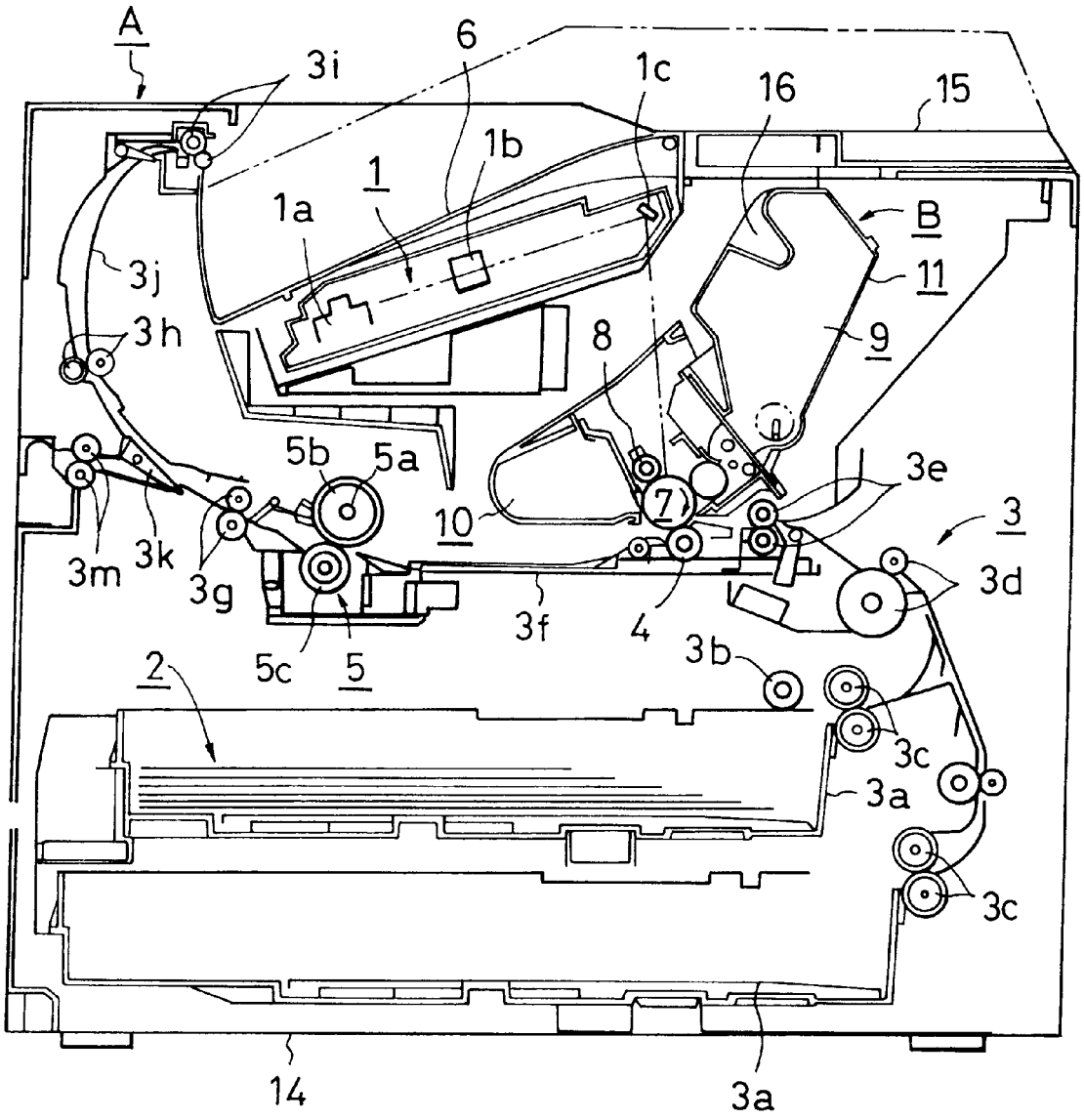
FIG. 3 is a cross sectional view of an image forming apparatus utilizing a developing device of the embodiment of the present invention.

FIG. 3 is a cross sectional view of an image forming apparatus utilizing the developing device of the present invention.

The developing device of the present embodiment is formed into a unitary structure with the photosensitive drum used for carrying an electrostatic latent image and is incorporated in a process cartridge which can be mounted to and dismounted from the apparatus body by an operator.

As illustrated in FIG. 3, an image forming apparatus A comprises optical means 1 including a polygon mirror 1*a*, a lens 1*b* and a reflecting mirror 1*c*. A laser beam emitted from a light source in accordance with the image information scans the polygon mirror 1*a*, passes through the lens 1*b*, and is reflected by the reflecting mirror 1*c*, resulting in the formation of a light image based on the image information. The light image from the optical means 1 illuminates a photosensitive drum 7, which is a latent image carrying member, in order to form a toner image on the photosensitive drum 7.

From a cassette 3*a*, the recording medium 2 such as paper is transported and turned over by means of pickup roller 3*b*, transporting roller pairs 3*c* and 3*d*, and register roller pairs 3*e*, so as to be in synchronization with the aforementioned toner image formation. The roller 3*b*, roller pairs 3*c*, and transporting roller pairs 3*d*, and the register roller pairs 3*e* together comprise transporting means 3. In the image forming section in the process cartridge B, a voltage is applied to a transfer roller 4 serving as transfer means in order to transfer the toner image on the photosensitive drum 7 onto the recording medium 2.

The recording medium 2 with the transferred toner image is guided by a guide member 3*f* to fixing means 5 including a fixing roller 5*b* and a drive roller 5*c*. The fixing means 5*b* incorporates a heater 5*a* and the drive roller 5*c* presses the recording medium 2 against the fixing roller 5*b* so as to fix the transferred toner image onto the recording medium 2.

Thereafter, the recording medium 2 is transported along a turn-over transportation path 3*j* by means of roller pairs 3*g*, 3*h*, and 3*i* and discharged to a discharge section 6. It is to be noted that the recording medium 2 does not have to pass through the turn-over transportation path 3*j* in order to be discharged. The medium 2 can be discharged directly to the discharge section via a discharge roller pair 3*m* by the operation of a swingable flapper 3*k*.

Figure 4:
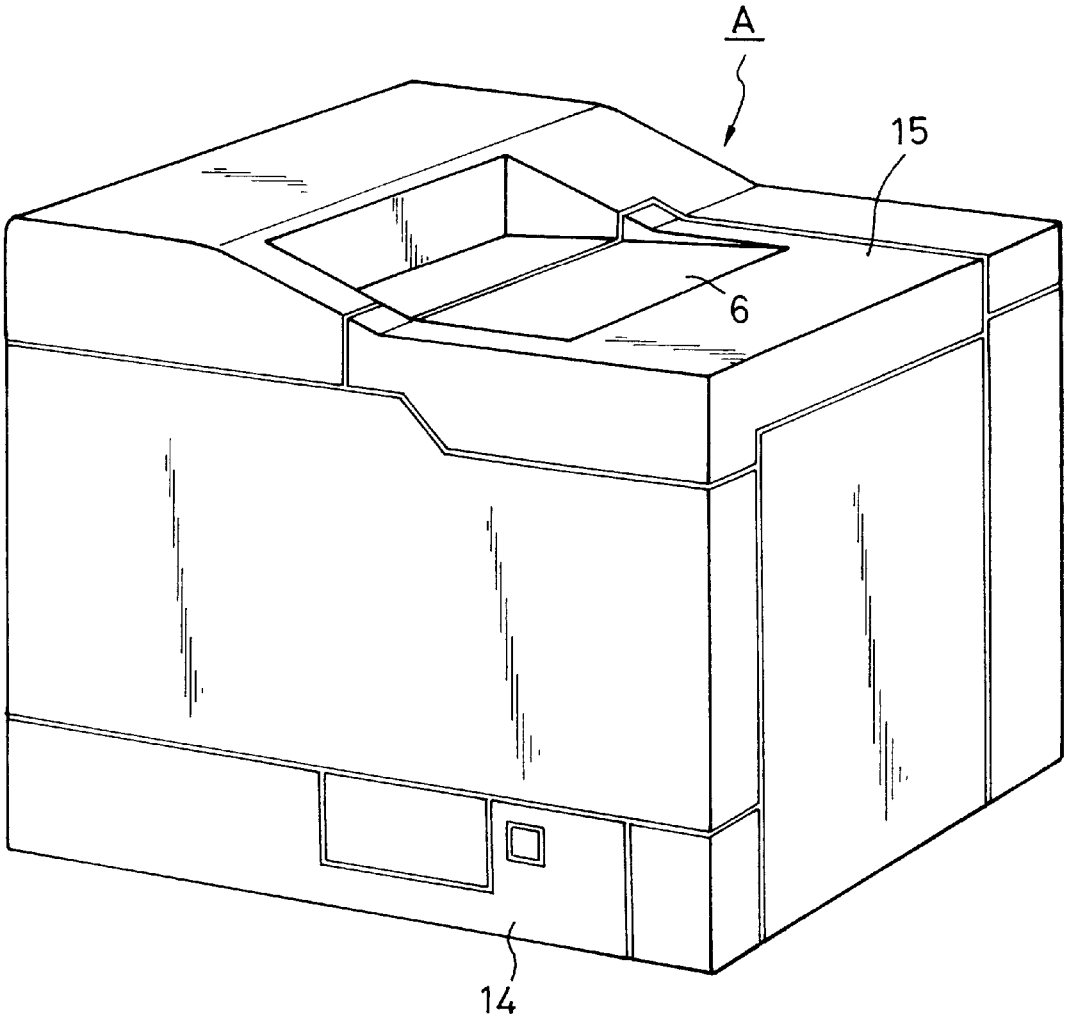
FIG. 4 is an external perspective view of the image forming apparatus of FIG. 3.
Figure 5:
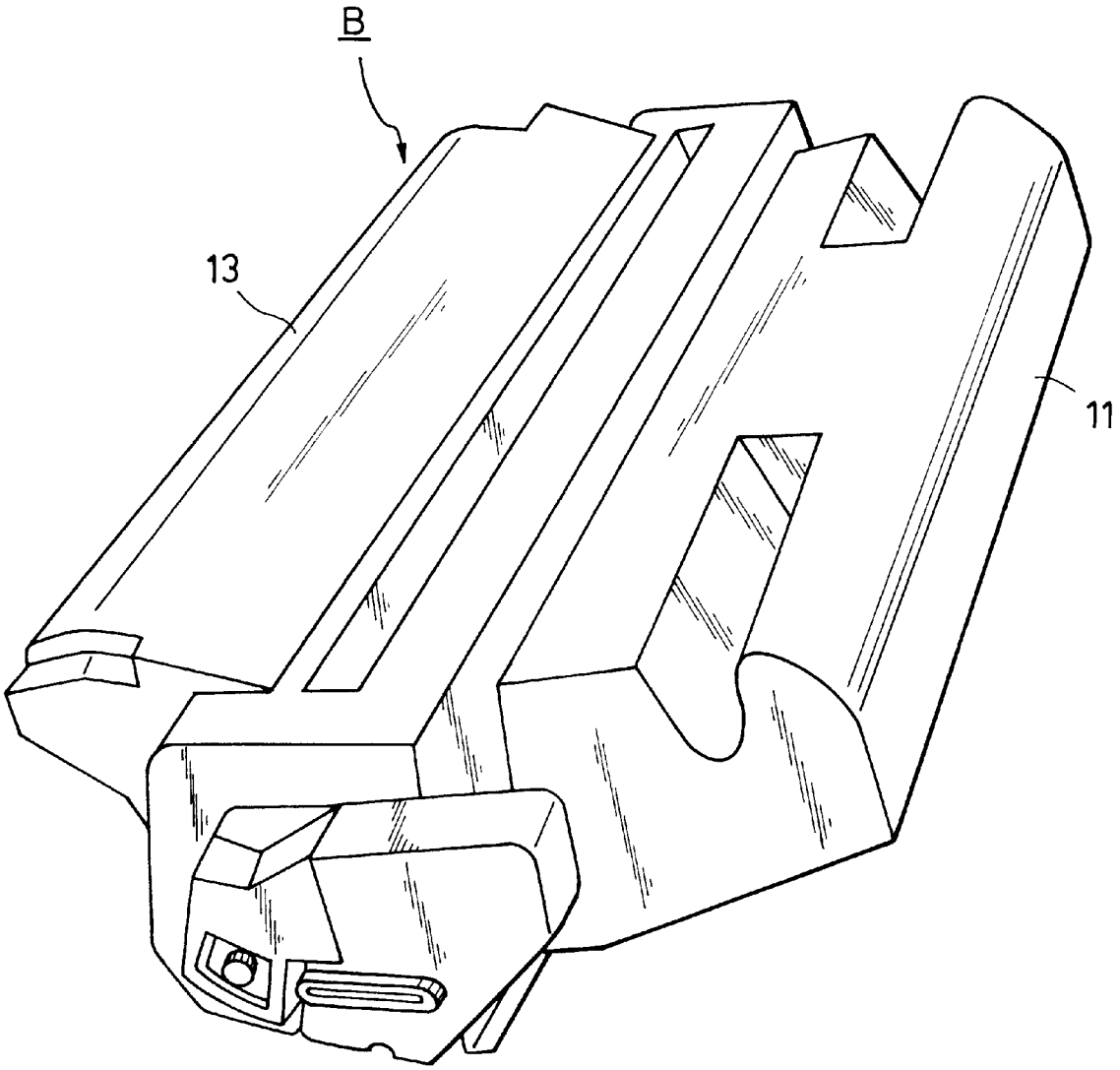
FIG. 5 is a perspective view of a process cartridge.

Process cartridge B, which is illustrated in FIG. 5, can be mounted to and dismounted from the apparatus body by opening a cover 15 of FIG. 4.

Figure 6:
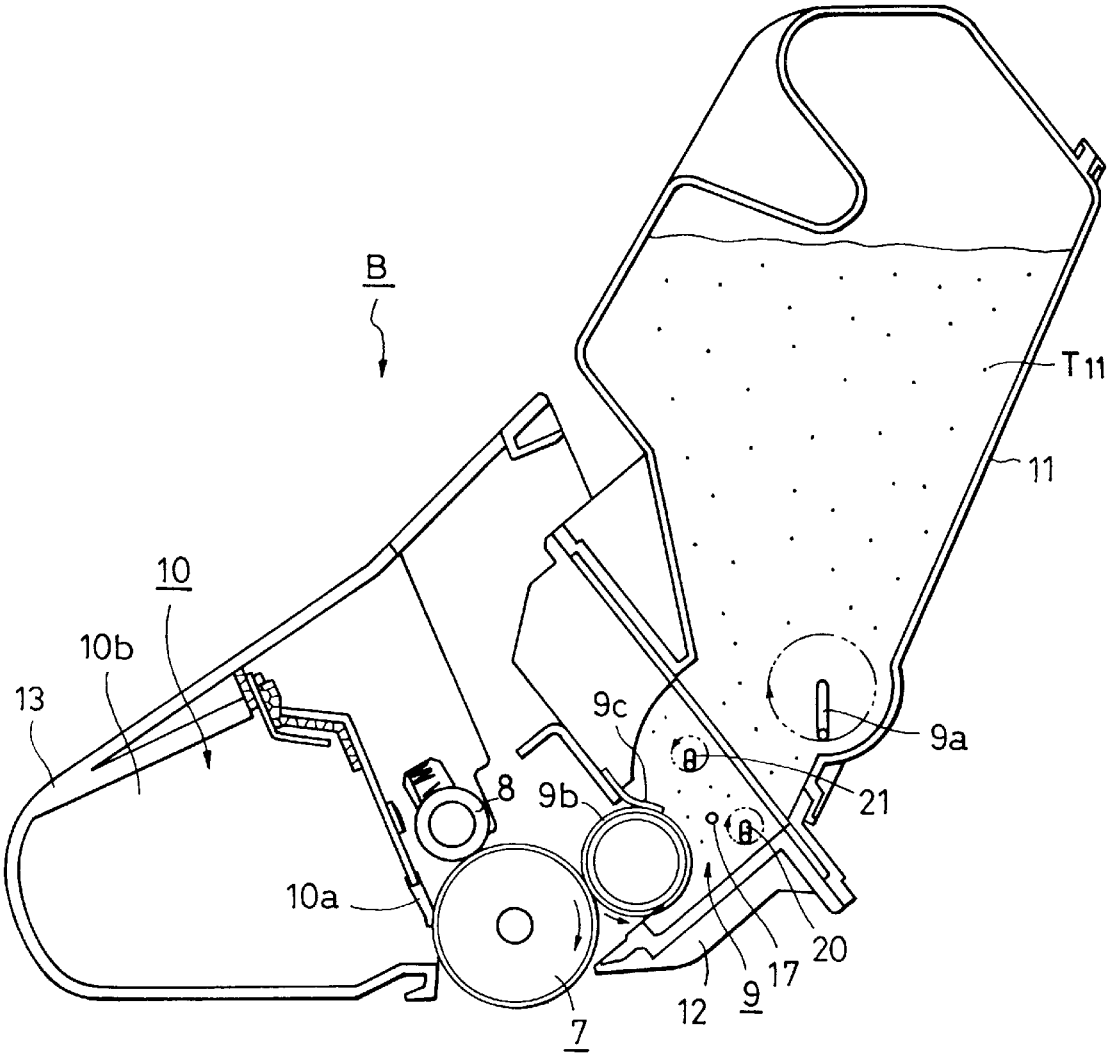
FIG. 6 is a cross sectional view of the process cartridge of FIG. 5.

FIG. 6 is a cross sectional view of the process cartridge B. Referring to FIG. 6, the process cartridge B incorporates a rotatable photosensitive drum 7, being a latent image carrying member with a photosensitive layer. The photosensitive drum 7 is uniformly charged as a result of applying a voltage to a charge roller 8 serving as charging means. The charged photosensitive drum 7 is exposed by a light image coming from the aforementioned optical means 1 via an exposure section, whereby a latent image is formed thereon in order to be developed by developing means or device 9.

The aforementioned developing means 9 includes a toner conveying member 9*a*, a development roller 9*b* which is a developer carrying member incorporating a stationary magnet 9*d*, and a development blade 9*c*. Toner $T_{11}$, being a one-component developer in the toner container 11, is conveyed out upon rotation of the toner conveying member 9*a*. Then, rotation of the development roller 9*b* causes the toner $T_{11}$ to form a toner layer charged by friction on the surface of the development roller 9*b* by means of a development blade 9*c* serving as developer limiting section. The toner is transferred onto the latent image on the photosensitive drum 7, resulting in the formation of a toner image that is visible.

A voltage with a polarity opposite to that used to form the aforementioned toner image is then applied to a transfer roller 4 in order to transfer the toner image onto the recording medium 2. After the toner image is transferred, the remaining toner is removed by cleaner means 10. More specifically, it is cleaned off from the photosensitive drum 7 by a cleaning blade 10*a* and collected by a toner collector 10*b*.

An antenna wire 17 is disposed a certain distance from the aforementioned development roller 9*b* in order to detect the remaining toner. The electrostatic capacity between the antenna wire 17 and the development roller 9*b* changes in accordance with the amount of toner remaining between the wire 17 and the roller 9*b*. The antenna wire 17 detects the remaining amount of toner by detecting changes in the electrostatic capacity in terms of changes in potential difference.

Each of the component parts including the aforementioned photosensitive drum 7 is incorporated in a cartridge as a unitary structure in a housing. In the unitary structure, the toner container 11 containing the toner and the development unit 12 supporting the development member including the development roller 9*b* are connected together. To this assembly is connected the photosensitive drum 7 and the cleaning container 13 supporting the cleaner blade 10*a* and the like. The process cartridge B is removably mounted to cartridge mounting means provided at the apparatus body. When the toner container 11 runs out of toner $T_{11}$, the process cartridge is replaced with a process cartridge containing a new supply of toner $T_{11}$.

A description will now be given of the developing device 9 in the present embodiment.

The developing device 9 of the present embodiment includes toner container 11 that contains toner $T_{11}$ before use of the developing device and a development container 12 with a development opening.

Before use, the part between the toner container 11 and the developer container 12 is provided with a seal film (not shown) in order to eliminate toner leakage toward the development container 12.

A toner conveying member 9*a* is provided at the toner container 11 in order to convey toner toward the development container 12. Development roller 9*b* that carries toner is provided at the development opening of the development container 12. A development blade 9*c* and toner conveying members 20, 21 are also provided at the development container 12. The development blade 9*c* operates to limit the thickness of the toner layer on the development roller 9*c* and the toner conveying members 20, 21 operate to circulate the toner in the development container 12.

The toner conveying member 9*a* serving as developer conveying means in the toner container 11, the toner conveying members 20, 21 serving as developer conveying means in the development container 12, and the development roller 9*b* each rotate in the direction indicated by the arrows in FIG. 6.

More specifically, the toner conveying member 20 and the roller 9*b* move in opposite directions, whereas the toner conveying member 21 and the roller 9*b* move in the same direction.

Figure 7:
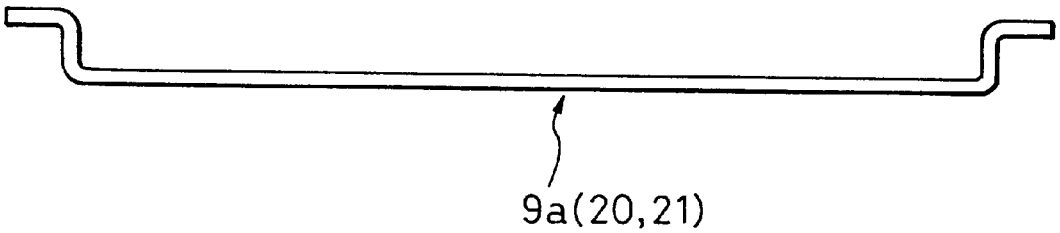
FIG. 7 is a front view of a toner conveying member.
Figure 8:
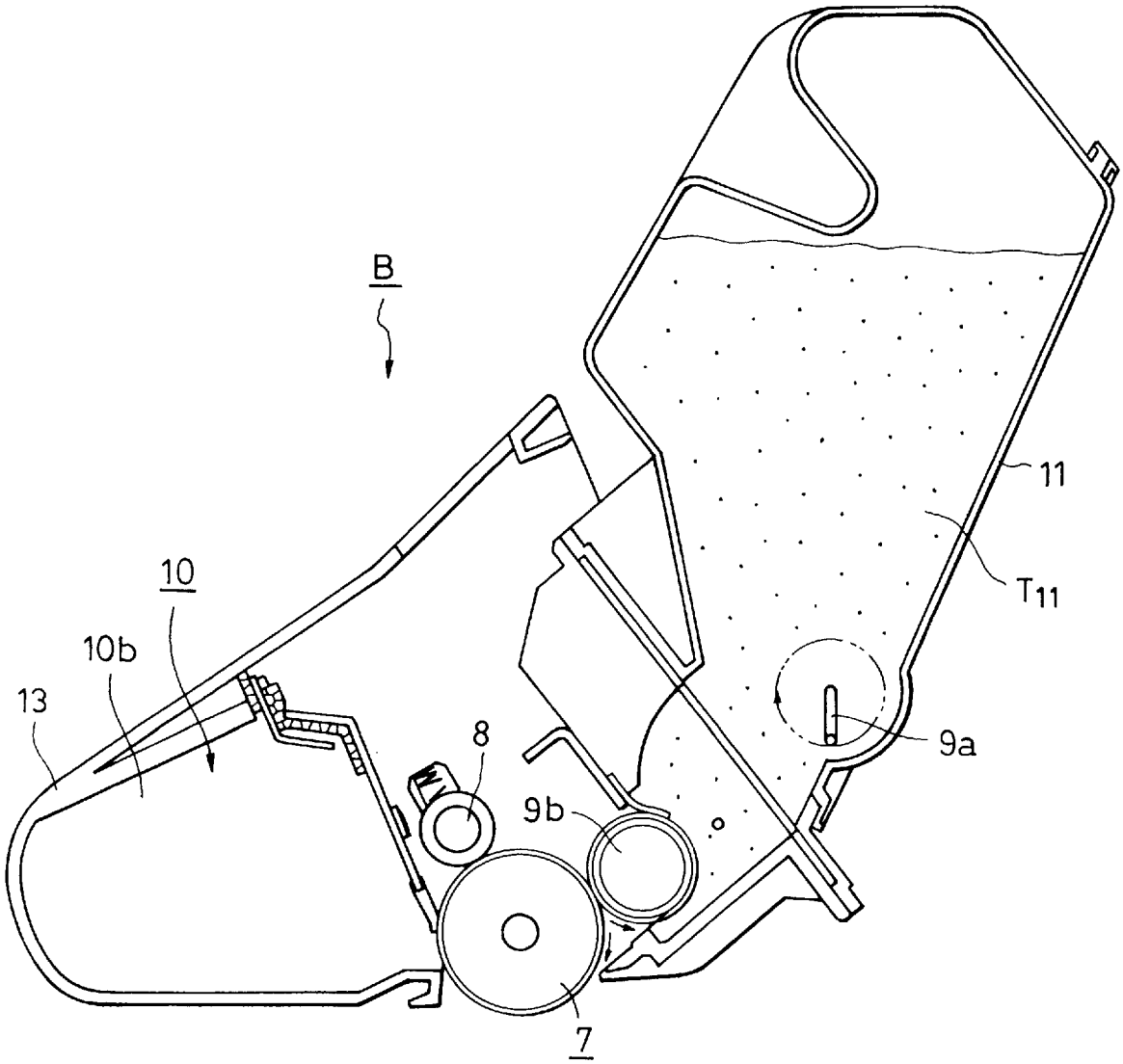
PRIOR ART FIG. 8
FIG. 8 is a cross sectional view of a conventional process cartridge.
Figure 9A:
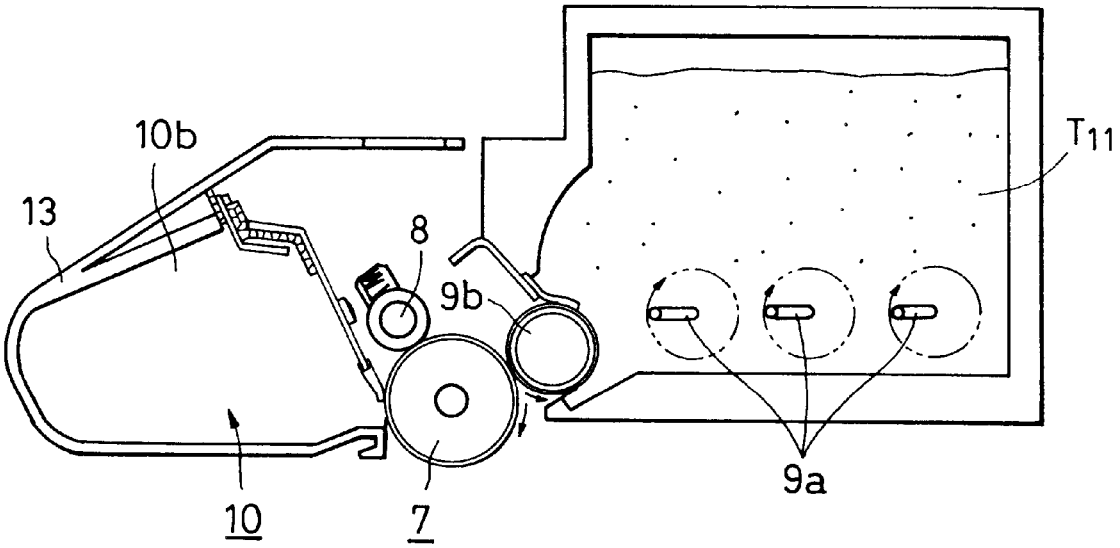
FIGS. 9A and 9B are each cross sectional views of a process cartridge.
Figure 9B:
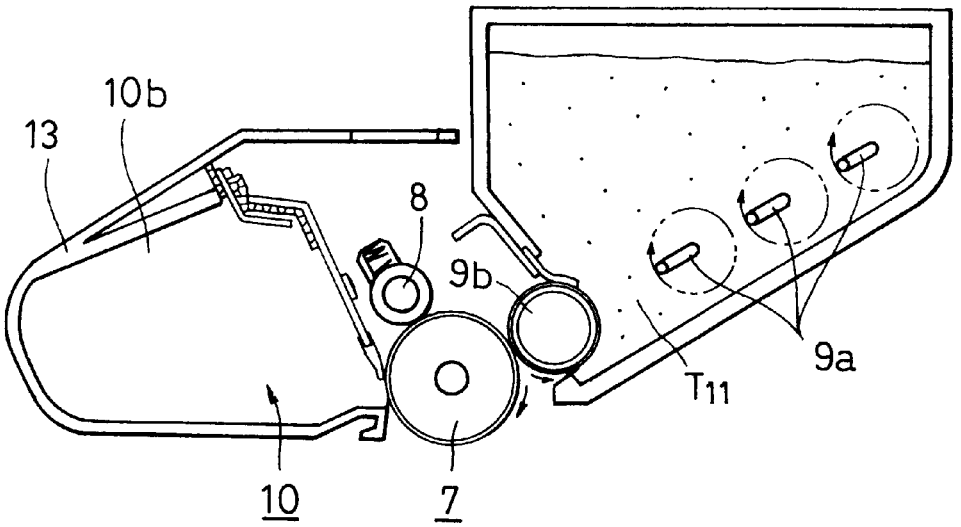

Each toner conveying member has the form illustrated in FIG. 7. The toner conveying member 21 is the fastest rotating member, the toner conveying member 20 is the next fastest rotating member, and the toner conveying member 9*a* is the least fast rotating member.

The toner conveying members 20, 21 have about the same rotational outer diameters, but the faster toner conveying member 21 has a higher toner conveying capability than the toner conveying member 20.

Figure 1:
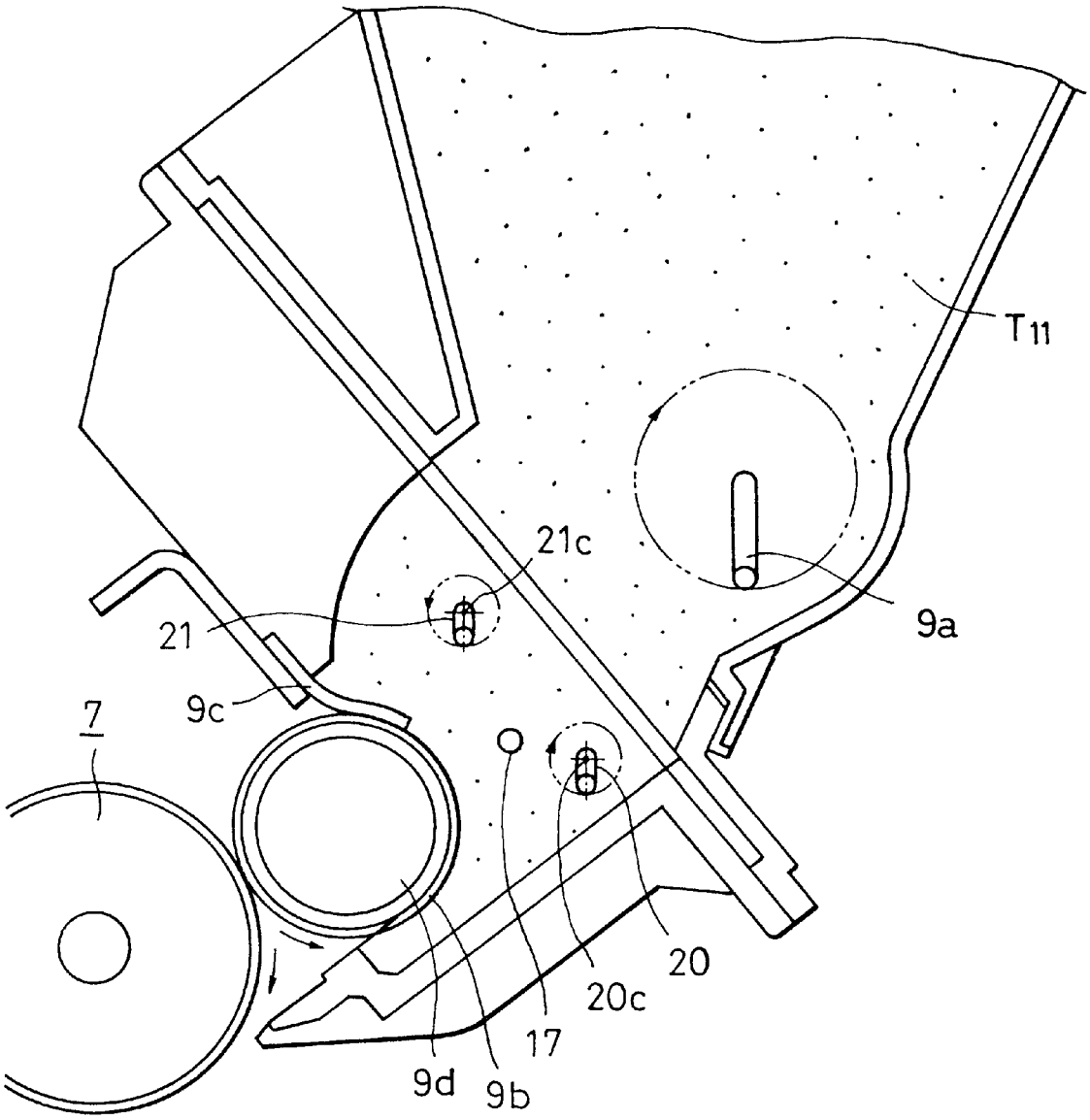
FIGS. 1 and 2 are each partial cross sectional views of an embodiment of a developing device in accordance with the present invention.

As illustrated in FIG. 1, the rotational center 21*c* of the toner conveying member 21 is located farther downstream than the free end of the development blade 9*c* as viewed in the direction of rotation of the development roller 9*b*. On the other hand, the rotational center 20*c* of the toner conveying member 20 is located farther upstream than the free end of the development blade 9*c* as viewed in the direction of rotation of the development roller 9*b*.

Figure 2:
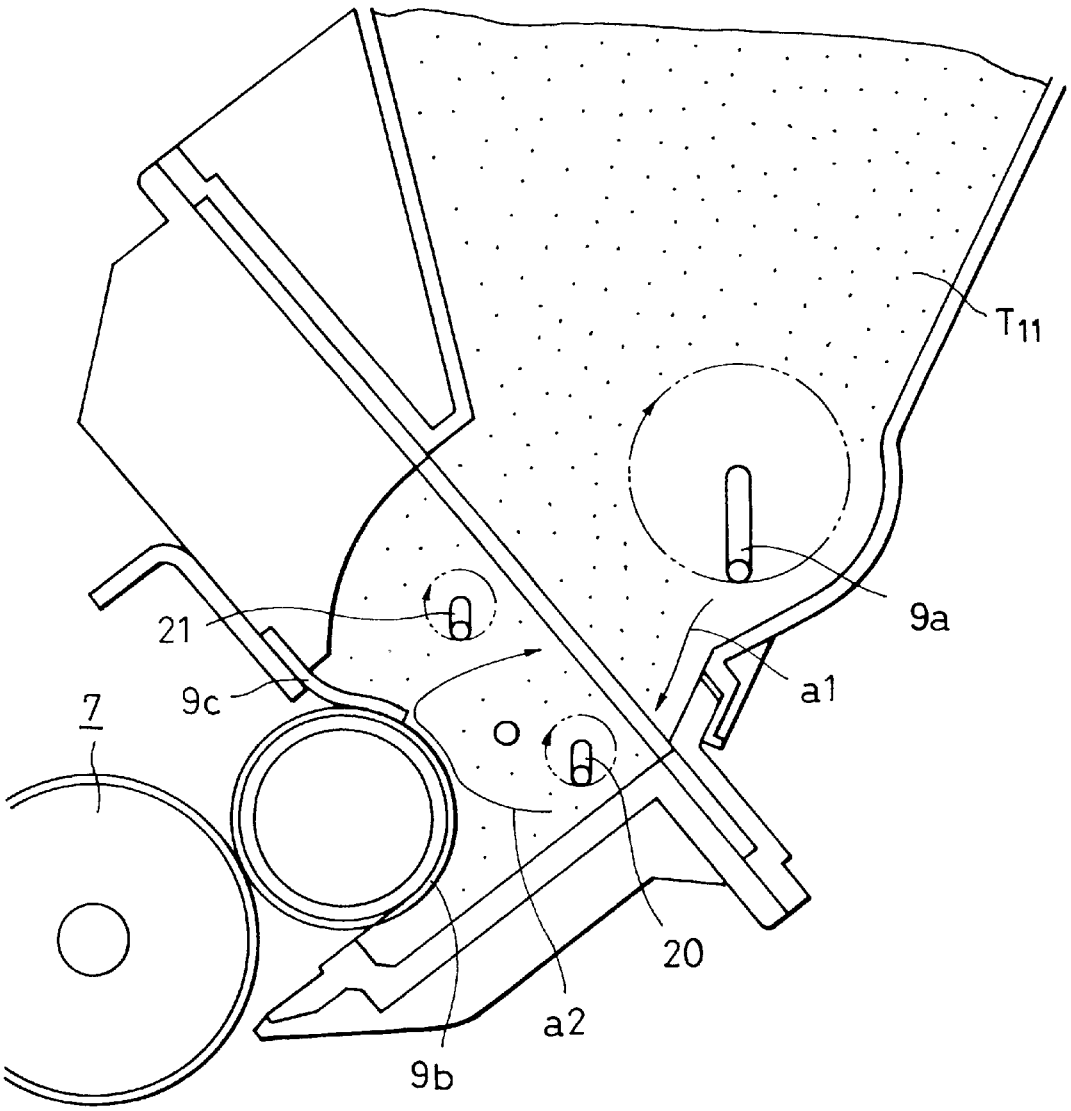

Thus, in the present embodiment, as illustrated in FIG. 2, the toner $T_{11}$ in the toner container 11 moves in the direction of arrow al and toward the development container 12 as a result of the rotation of the toner conveying member 9*a*. Then, the toner $T_{11}$ moves toward the development roller 9*b* and along or near the surface of the development roller 9*b* as a result of the rotation of the toner conveying member 20. A portion of the toner $T_{11}$, being carried by the roller 9*b*, rotates therewith towards the part of the developing section that faces the photosensitive drum 7. The rest of the toner $T_{11}$ moves in the direction of arrow a2 from the free end of the development blade 9*c* as a result of the rotation of the toner conveying member 21, and then moves again toward the development roller 9*b* as a result of the rotation of the toner conveying member 20, whereby the toner is circulated in the vicinity of the development roller 9*b*.

More specifically, in the region farther upstream than the free end of the development blade 9*c* as viewed in the direction of rotation of the development roller 9*b* the rotation of the development roller 9*b* also causes movement of the toner, in addition to the rotation of the toner conveying member 20. Therefore, the downstream toner conveying member 21, rotated at a high speed, opposes the developer conveying forces produced by both the toner conveying member 20 and the development roller 9*b* in order to move the toner, making it possible to circulate the toner without forcing it into the upper section of the free end of the development blade 9*c*.

In the present embodiment, the photosensitive drum 7 has an outer diameter of 30 mm and a rotating speed of 67.3 r.p.m.; the development roller 9*b* has an outer diameter of 20 mm and a rotating speed of 120.5 r.p.m.; the toner conveying member 9*a* has a rotational outer diameter (indicated by alternate long and two short dashed line in the figures) of 20 mm and a rotating speed of 9.4 r.p.m.; the toner conveying member 20 has a rotational outer diameter (indicated by alternate long and two short dashed line in the figures) of 6.4 mm and a rotating speed of 28.9 r.p.m.; and the toner conveying member 21 has a rotational outer diameter (indicated by alternate long and two short dashed line in the figures) of 6.4 mm and a rotating speed of 116.1 r.p.m. The process cartridge of the present embodiment of FIG. 1 shown in section has a length of 301 mm, and can contain 800 grams of toner.

While a preferred embodiment of the present invention has been described, it is to be understood that various modifications may be made without departing from the scope of the present invention.

What is claimed is:

1. A developing device comprising:

a container member containing a developer;

a rotating developer carrying member which is provided at an opening of said container member and carries the developer in said container as said developer carrying member rotates;

a first developer conveying member disposed so as to face said developer carrying member, wherein a direction of rotation of said first developer conveying member is opposite to a direction of rotation of said developer carrying member; and a second developer conveying member disposed so as to face said developer carrying member and downstream from said first developer conveying member in the direction of rotation of said developer carrying member;

wherein a toner conveying capability of said second developer conveying member is greater than a toner conveying capability of said first developer conveying member.

2. A developing device according to claim 1, wherein said second developer conveying member has a greater rotating speed than said first developer conveying member.

3. A developing device according to claim 1, wherein the direction of rotation of said second developer conveying member is the same to the direction of rotation of said developer carrying member.

4. A developing device according to claim 1 further comprising a regulating blade for regulating a thickness of a developer layer on said developer carrying member, wherein the center of rotation of said first developer conveying member is located upstream from a free end of said regulating blade in the direction of rotation of said developer carrying member and wherein a center of rotation of said second developer conveying member is located downstream from the free end of said blade in the direction of rotation of said developer carrying member.

5. A developing device according to claim 1, further comprising a developer container connected to said container member, said container member being supplied with a developer from said developer container.

6. A developing device according to claim 5, wherein said first and second developer conveying members are provided within said container member, said device further comprising a third developer conveying member within said developer container in order to convey a developer within said developer container.

7. A developing device according to claim 6, wherein said third developer conveying member has a smaller rotating speed than the first developer conveying member.

8. A developing device according to claim 1, wherein said second developer conveying member is positioned upwardly of said first developer conveying member.

9. A developing device according to claim 1, wherein said device forms part of a cartridge structure, the cartridge being removably mountable to an image forming apparatus.

10. A developing device according to claim 9, wherein said device forms part of a process cartridge in such a manner so as to form an integral structure with an image carrying member that carries an electrostatic latent image.

* * * * *

UNITED STATES PATENT AND TRADEMARK OFFICE

CERTIFICATE OF CORRECTION

PATENT NO. : 5,899,607

DATED : May 4, 1999

INVENTOR(S) : HIDESHI KAWAGUCHI, ET AL.

It is certified that error appears in the above-identified patent and that said Letters Patent is hereby corrected as shown below:

COLUMN 1,
Line 17, "carrying-" should read --carrying--.

COLUMN 6,
Line 5, "claim 1" should read --claim 1,--.

Signed and Sealed this

Ninth Day of November, 1999

*Attest:*

Q. TODD DICKINSON

*Attesting Officer*

*Acting Commissioner of Patents and Trademarks*